US010145142B1

(12) United States Patent
Jansen

(10) Patent No.: US 10,145,142 B1
(45) Date of Patent: Dec. 4, 2018

(54) FENCE PANEL INSTALLATION SYSTEM

(71) Applicant: Mark Edward Jansen, Remer, MN (US)

(72) Inventor: Mark Edward Jansen, Remer, MN (US)

(73) Assignee: DIY Fence Inc., Remer, MN (US)

( * ) Notice: Subject to any disclaimer, the term of this patent is extended or adjusted under 35 U.S.C. 154(b) by 0 days.

(21) Appl. No.: 15/049,057

(22) Filed: Feb. 20, 2016

Related U.S. Application Data

(60) Provisional application No. 62/140,201, filed on Mar. 30, 2015.

(51) Int. Cl.
*E04H 17/20* (2006.01)
*E04H 17/26* (2006.01)
*E04H 17/16* (2006.01)

(52) U.S. Cl.
CPC ..... *E04H 17/26* (2013.01); *E04H 17/165* (2013.01); *E04H 17/168* (2013.01)

(58) Field of Classification Search
CPC ..... E04H 17/26; E04H 17/168; E04H 17/165; E04H 17/261; E04H 17/263
USPC ..... 256/DIG. 4, 59–65.16; 52/745.1
See application file for complete search history.

(56) References Cited

U.S. PATENT DOCUMENTS

| | | | | |
|---|---|---|---|---|
| 4,135,655 | A | 1/1979 | Brown | |
| D288,276 | S | 2/1987 | Harney | |
| 8,210,504 | B1 | 7/2012 | Skornickel | |
| 8,403,311 | B2 * | 3/2013 | Ross | E04H 17/00 269/36 |
| 9,033,314 | B1 * | 5/2015 | Roddy | F16L 3/12 256/1 |
| 2004/0188667 | A1 * | 9/2004 | Ray | A01K 3/00 256/67 |
| 2008/0298911 | A1 | 12/2008 | Platt | |
| 2011/0272659 | A1 | 11/2011 | Gutierrez | |
| 2012/0080574 | A1 | 4/2012 | Mills | |
| 2015/0008384 | A1 | 1/2015 | Roddy et al. | |
| 2015/0197960 | A1 | 7/2015 | Woods | |

* cited by examiner

*Primary Examiner* — Brian E Glessner
*Assistant Examiner* — Adam G Barlow
(74) *Attorney, Agent, or Firm* — Berggren Law Offices, LLC; William R Berggren

(57) ABSTRACT

A system of for installing fence posts quickly, accurately, and easily for both side mounted fence panels and front mounted fence panels with one or two persons.

20 Claims, 6 Drawing Sheets

117
115

A1
126
128
130
116
C
120
118
114
140

B2
B1
B
110
C
116
140
112
114
118
124
128

100
140
A
A1
A2
110

FENCE PANEL INSTALLATION SYSTEM

FIELD OF THE INVENTION

This invention relates to a fence panel installation system.

BACKGROUND OF THE INVENTION

There is a need for a fence panel installation system that is allows one person to easily install fence panels in a fence.

It is difficult and time consuming for a single person to install fence panels and their support brackets. Panels are heavy, awkward, and hard to align in the brackets. When installing brackets, there is nothing to hold them in place while measuring, centering, leveling, drilling, and tightening screws.

Current fence panel installation systems do not solve the problems. Nothing currently exists to hold the fence panel brackets in place while installing them to fence posts having various widths. In addition, there is nothing made to also lift, move, stabilize, or align panels prior to installation.

There still is a need for a fence post installation system that is allows one person to easily, accurately, and quickly install fence posts.

SUMMARY OF THE INVENTION

I have invented a system of tools for installing a fence panel, either wood or vinyl, and either between fence posts or adjacent to each other on the front surfaces of fence posts. The system for installing a fence panel has three aspects, an article aspect and two method aspects. The article aspect, a fence panel installation system, includes two elements, at least one horizontal support element, and an alignment member. The horizontal support element includes four features, a left and right portion, a flat base, a back, and a flexible attachment element. The left portion and right portion are configured to be slideably engaged to accommodate fence posts with various horizontal widths. The base includes a back edge, a left edge, a right edge, a front edge, a top surface, at least a left portion and a right portion, and a length that is configured to extend beyond the horizontal width of a face of a fence post on which a panel mounting bracket is configured to be releasably affixed. The back includes a back surface configured to be partially in contact with a face of a fence post and at least a left portion and a right portion that extend at right angles down from the back edge of each portion of the base and has at least a left portion that has left end and a length that extends from proximate the left edge of the base, a right portion that has right end and a length that extends from proximate the right edge of the base. The flexible attachment element is attached to the left and right portion of the back and is configured to allow the horizontal support element to be elastically releasably attached to the fence post at a predetermined location in a manner not using a clamp.

The first method aspect is for mounting a fence panel between the faces of two fence posts to form a side-mounted fence. This method includes ten steps. The first step is providing at least a first anchored fence post of a pair and a second anchored fence post of a pair each with a front face and without a fence panel between them, at least one fence panel, and enough pairs of brackets necessary to install the fence panel between the first and second anchored fence post. The second is providing a fence post installation system that includes the elements of the article discussed above. The third step is releasably affixing a horizontal support element to the side of the first fence post at predetermined location. The fourth step is affixing the first of a pair of first fence panel brackets to the first fence post. The fifth step is releasably affixing the horizontal support element to a facing face of the second fence post wherein there is no fence panel between the first fence post and the second fence post and at predetermined location using the alignment member to determine a level location for the first horizontal support element and the second horizontal support element. The sixth step is affixing the second of a pair of fence panel brackets to the second fence post. The seventh step is repeating steps three to six until all pairs of fence panel brackets necessary to mount a fence panel are on the facing faces of the two fence posts. The eighth step is positioning the fence panel into the brackets. The ninth step is affixing the fence panel to the fence panel brackets to form a first fence post and a second fence post with a fence panel between them. The tenth step is repeating steps three to nine on the next panel until all panels are installed. In some embodiments, the alignment member is used to determine vertical distances between brackets in a vertical direction.

The second method aspect is for mounting a fence panel on the front faces of two fence posts to form a front-mounted fence. This method includes seven steps. The first step is providing at least a first and a second anchored fence post each with a front face and without a fence panel between them and at least one fence panel to be mounted on the front face of the first and second anchored fence panel. The second step is providing a fence post installation system that includes the elements of the article discussed above but with a first horizontal support element and a second horizontal support element. The third step is releasably affixing the first horizontal support element to front face of the first fence post and the second horizontal support element to the front face of the second fence post wherein there is no fence panel between the first fence post and the second fence post and at predetermined locations using the alignment member to determine a level location for the first horizontal support element and the second horizontal support element. The fourth step is more securely affixing the first horizontal support element to the first fence post and the second horizontal support element to the second fence post. The fifth step is positioning the fence panel onto the horizontal support element of each fence post and affixing the facing fence panel to each fence post to form a first fence post and a second fence post with a fence panel between them. The sixth steep is releasing the first horizontal support element from the first fence post and the second horizontal support element from the second fence post. The seventh step is repeating steps three through six on the next panel until all panels are installed.

My fence panel installation system allows one person to install fence panels easily quickly and accurately. It is configured to work with both side mounted and face mounted fence panels. It is also able to work with fence posts having various widths. My first element can hold in place fence panel brackets while drilling and attaching screws with no need for measuring or leveling, or hold in place face mounted panels until they are affixed to a pair of fence posts. My second element accurately levels or measures the location of a second end of a fence post bracket or panel on a second fence post to install either a first set or subsequent sets of fence panel brackets or fence panels much quicker than with current basic tools. My optional third element makes it easy for one person to handle awkward fence panels while installing them.

BRIEF DESCRIPTION OF THE DRAWINGS

One or more features or preferred forms of the invention are described in the accompanying drawings. The drawings are described briefly below.

Figures 1, 1A, 1B, 1C:
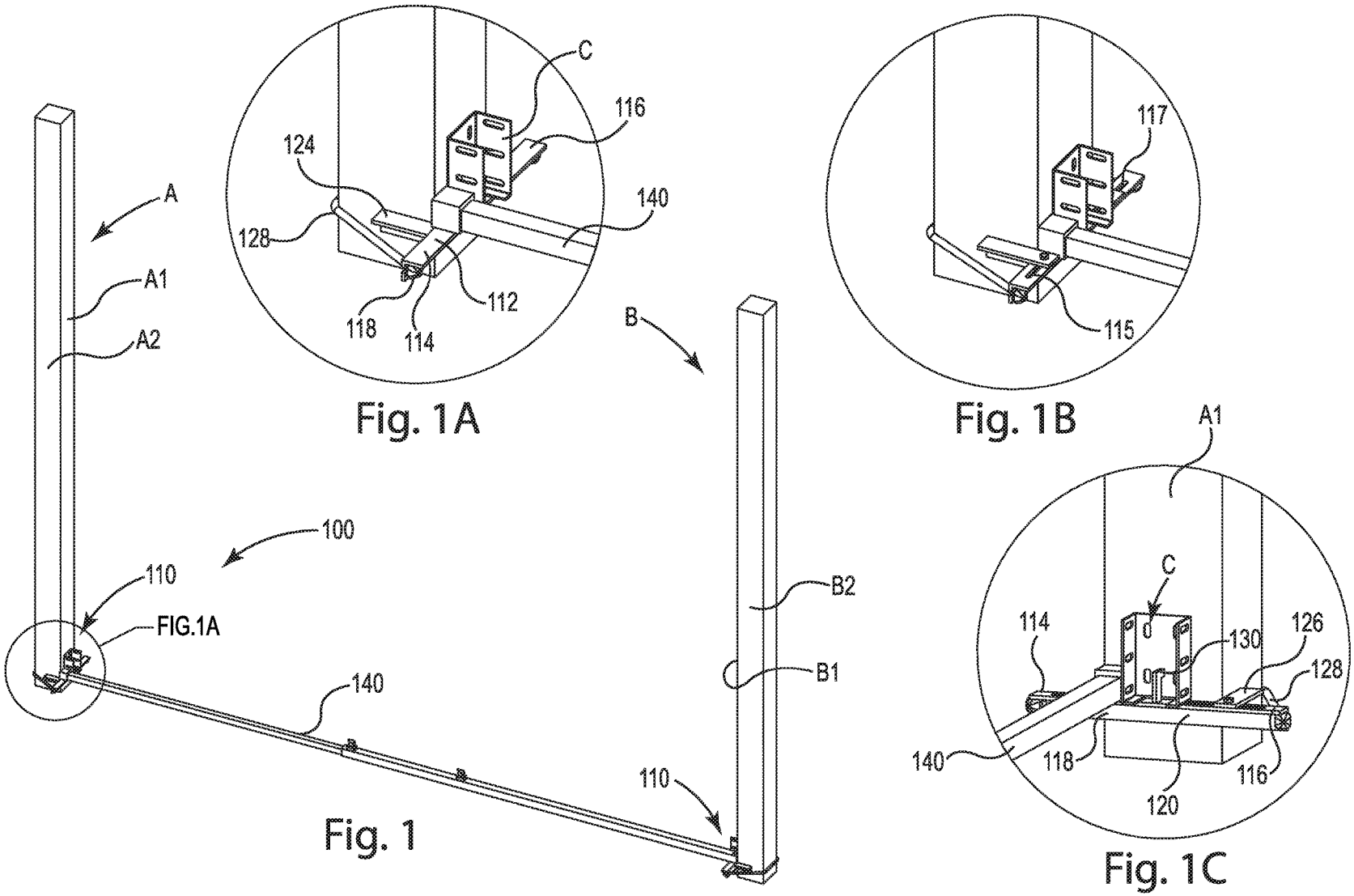
FIG. 1 is an illustration of an embodiment of the invention used for installing a fence panel between two fence posts.
FIG. 1A is an illustration of a close up of the horizontal support element of FIG. 1.
FIG. 1B is an illustration of another view of a close up of the horizontal support element of FIG. 1.
FIG. 1C is an illustration of a close up of another embodiment of a horizontal support element.

While the invention is amenable to various modifications and alternative forms, some specifics have been shown by way of example in the drawings and will be described in detail below. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF SOME EMBODIMENTS OF THE INVENTION

It is difficult and time consuming to install fence panels and their support brackets or front-mounted fence panels by yourself. Panels are heavy, awkward, and hard to align in the brackets or hold against the front face of a fence post. When installing brackets, there is nothing to hold them in place while measuring, centering, leveling, drilling, and tightening screws. Similarly, when installing front mounted panels there is nothing to hold them in place while measuring, centering, leveling, drilling, and tightening screws. The invention described here solves this problem.

The elements of the invention have specific benefits. My first element, the horizontal support element, can hold in place fence panel brackets while drilling and attaching screws with no need for measuring or leveling. When attaching the holding support element, to a post prior to installing the bracket you are able to hold the bracket in place, center it, level it, drill holes, and tighten screws with no movement. You are also able to hold a face mounted fence panel in place while you level it, drill holes, and tighten screws with no movement. My second element, the alignment member, allows you to accurately level or measure to install another fence panel bracket much quicker than basic tools. Using the second element, the alignment member, you can level the second bracket or second face-mounted horizontal support element to a second fence post prior to mounting a fence panel. You may also measure vertically to install upper brackets. In some embodiments, using two horizontal support elements at a time makes accurate bracket installation easier. My optional third element, the lifting and alignment tool, makes it easy for one person to handle awkward fence panels while installing them. For installing fence panels, a person is able to use of the lifting and alignment tool to lift the panel, stabilize it, move it, and align it with the brackets that hold it in place. You may also use my lifting and alignment tool in the same way to install fence panels that are mounted to the face of two fence posts on the stabilizing brackets.

This invention is an improvement on what currently exists. The only thing I've seen used to install fence panel brackets are tape measures, levels, pencils, squares and other basic tools. My tools and system are totally new from anything that exists on the market making it simple for one person to do all the work by themselves. Tools that hold a bracket in place to mount it to a fence post are taught in patent literature but are cumbersome and not easily adaptable to fence posts with different widths. The basic tools being used are too slow, not as accurate, and cannot accomplish the functions that my invention can. For both installing side mounted fence panels and face mounted fence panels.

The system for installing a fence panel has three aspects, an article aspect and two method aspects. The article aspect, a fence panel installation system, includes two elements, at least one horizontal support element, and an alignment member. The horizontal support element includes four features, a left and right portion, a flat base, a back, and a flexible attachment element. The left portion and right portion are configured to be slideably engaged to accommodate fence posts with various horizontal widths. In some embodiments, the left and right portions are unified.

The base includes a back edge, a left edge, a right edge, a front edge, a top surface, at least a left portion and a right portion, and a length that is configured to extend beyond the horizontal width of a face of a fence post on which a panel mounting bracket is configured to be releasably affixed.

The back includes a back surface configured to be partially in contact with a face of a fence post and at least a left portion and a right portion that extend at right angles down from the back edge of each portion of the base and has at least a left portion that has left end and a length that extends from proximate the left edge of the base, a right portion that has right end and a length that extends from proximate the right edge of the base.

The flexible attachment element is attached to the left and right portion of the back and is configured to allow the horizontal support element to be elastically releasably attached to the fence post at a predetermined location in a manner not using a clamp. The fence panel installation system also includes an alignment member with a left end and a right end and an adjustable length that has two portions that are slideably engaged, the left end is proximate to the fence post, and the right end is proximate to another fence post.

The fence panel installation system also includes an alignment member with a left end and a right end and an adjustable length that has two portions that are slideably engaged, the left end is proximate to the fence post, and the right end is proximate to another fence post.

In some embodiments, the fence panel installation system of the invention includes a second horizontal support element. This allows a person to install the fence panel even more quickly.

In some embodiments, the fence panel installation system may be further modified to better accommodate side mounted fence panels held in place with fence panel brackets. In one embodiment, the base of the horizontal support element also includes at least one alignment element horizontally mounted and slideably engaged to the horizontal support element in a direction parallel to the back edge of the base. This permits the horizontal support element to be adjusted to accommodate fence posts with different widths. In another embodiment, the horizontal support element includes an alignment element slideably attached to each of the left portions and right portions of the horizontal support element. In still another embodiment, the alignment elements are unified with the horizontal support element.

Some embodiments configured to be used to install side mounted fence panels may further include a vertical engaging element attached to and rising up from the base of the horizontal support element and perpendicular to the front edge. The vertical engaging element has a rear edge and is configured to hold a fence bracket in position while it is being attached to a fence post typically with screws. Some embodiments have the rear edge configures with a projection off the rear edge to engage a hole in a fence panel bracket or the bracket between holes while the bracket can be affixed to the face of the fence post. Choice of where the bracket is engaged depends on whether the bracket is intended to be centered on the fence post side or offset to one edge.

In some embodiments, the alignment member is releasably affixed to the horizontal support member. One way is with a slit on the base of the horizontal support member parallel to the front edge of the base and a projection overhanging one end of on the alignment member that fits in the slit. In other embodiments that have two horizontal support elements, each may have a slit and the alignment member may have projection overhanging both ends that fit into the slits. This permits more consistent positioning of the alignment member between fence posts.

Some embodiments of the fence panel installation system of the invention also include a fence panel lifting and alignment tool. This tool includes a base, a brace, and a handle. The base is configured to hold the bottom of a fence panel to be installed on a set of fence panel brackets for a side mounted fence panel or a fence panel for a face mounted fence panel. The brace element is with a top and extends vertically from the base to a height of at least one-fourth of the height of the fence panel. The handle extends horizontally from the top of the brace.

Figure 2:
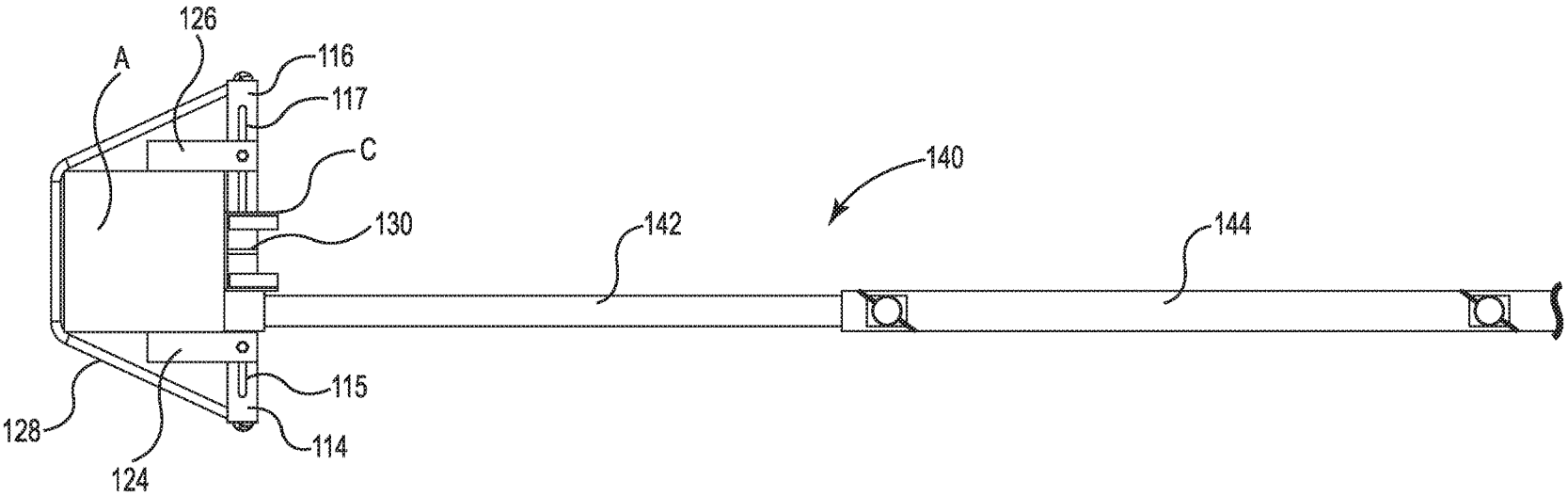
FIG. 2 is an illustration of a top view of the horizontal support element of—FIG. 1C with an alignment member.

FIGS. 1 and 2 show embodiments of the invention used for side mounted fence panels. FIG. 1 is an illustration of an embodiment of the invention used for installing a fence panel between two fence posts. A fence panel installation system (100) is shown between two Fence Post (A, B). A horizontal support element (110) is elastically attached to each fence post by a flexible attachment element (128). An orientation member (124, 126) is attached in a unified manner to each horizontal support element (110). An alignment member (140) is shown horizontally between the fence posts.

FIG. 1A is an illustration of a close up of the horizontal support element of FIG. 1. Horizontal support element 110 is shown holding a fence panel bracket (C) against Fence Post A. Also shown are base (112), with a left portion (114) and a right portion (116) attached to a left portion (118) of a back and a right portion (120) of the back not shown in FIG. 1A. A first orientation element (124) is shown unified to left base portion 114 and left back portion 118. A flexible .attachment element is shown releasably attached to the left portion (118) of the back. An alignment member (140) is shown extending from horizontal support element 110 on Fence Post A.

FIG. 1B is an illustration of a close up of another embodiment of a horizontal support element. In this embodiment, the first alignment element is slideably engaged with the left portion of the base through a slit (115) and the second orientation element is slideably engaged with the right portion of the base through a slit (117). An alignment member (140) is shown extending horizontally between Fence Post A and Fence Post B.

FIG. 1C is an illustration of another view of a close up of the horizontal support element of FIG. 1B. Here the second attachment element (120) is shown. A vertical element (130) is shown holding fence panel bracket C in place. An alignment member (140) is shown extending to a second horizontal support element 110 on Fence Post B.

FIG. 2 is an illustration of a top view of the horizontal support element of FIG. 1B and FIG. 1C with an alignment member. Shown is how flexible attachment element 128 is attached to Fence Post A. Also shown is how horizontal support element 110 is modified to accommodate fence posts with different widths. An alignment member (140) is shown extending horizontally between Fence Post A and Fence Post B with a first part (142) slideably engaged with a second part (144) to allow for an adjustable length.

In some embodiments, the fence panel installation system may be further modified to better accommodate front mounted fence panels. In one embodiment the horizontal support element further includes a vertical element having a left portion and a right portion and affixed to the front edge of the left and right portion of the base, extending upward at right angles to the base. In one embodiment, the left portion and the right portion of the vertical element is slideably engaged. In one embodiment, the vertical element also has a center portion that is not affixed to the base and the left and right portions are slideably engaged with each side of the center portion. In one embodiment, the left portion and the right portion of the vertical element are unified. In one embodiment, the back has at least two holes configured to permit the horizontal support element to be releasably affixed to the face of the fence post with, for example, lag bolts or screws or other temporarily adhering means such as, for example, mechanical fasteners, to permit a facing fence panel to rest upon the horizontal support element until the fence panel is affixed to the face of the fence post. In one embodiment, the alignment member has a projection at one end that is configured to engage the top of the base.

Figures 3, 3A, 3B, 3C:
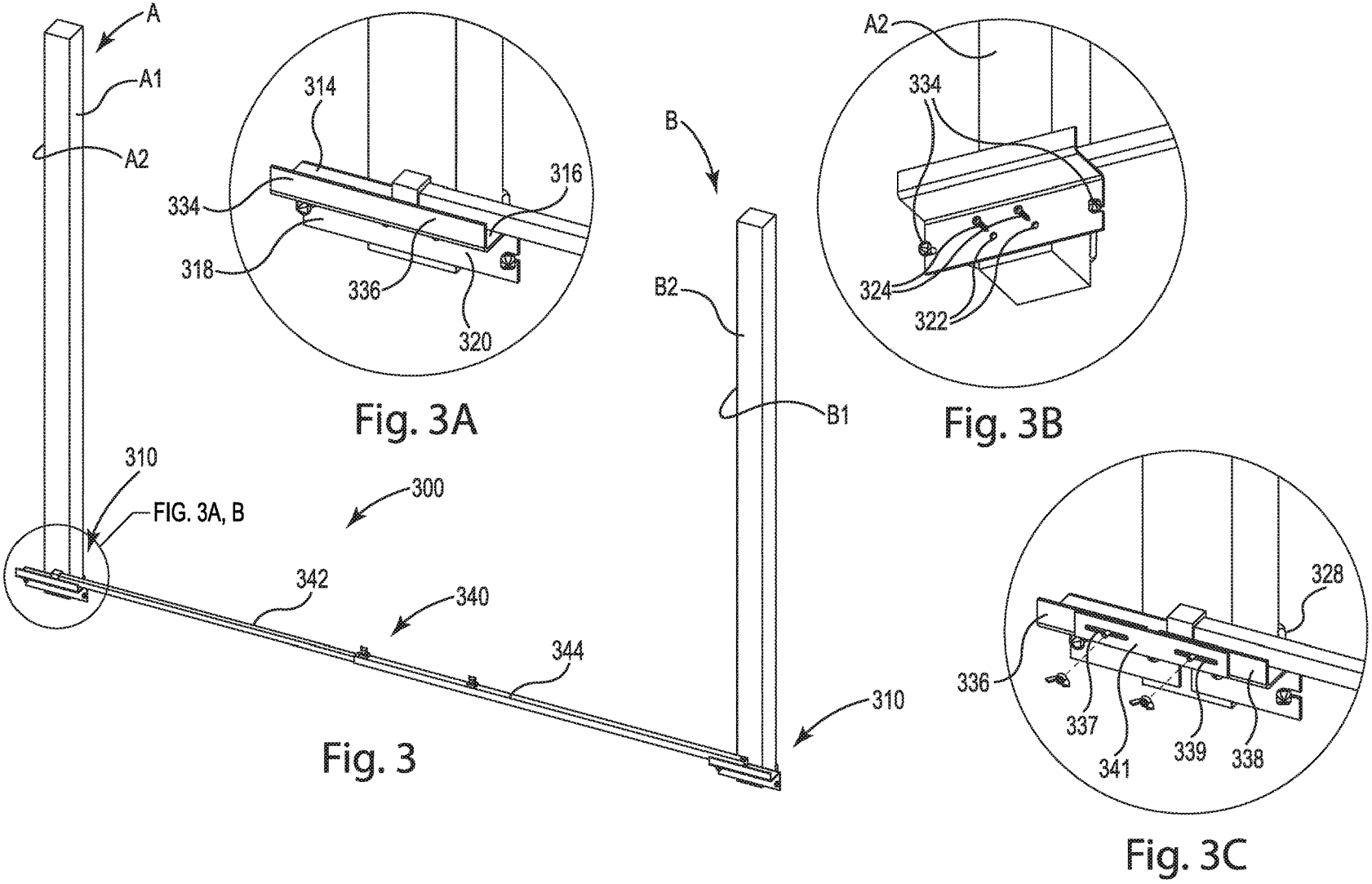
FIG. 3 is an illustration of another embodiment of the invention used for installing a fence panel on the front face of two fence posts.
FIG. 3A is an illustration of a close up of the horizontal support element of FIG. 3.
FIG. 3B is an illustration of another view of a close up of the horizontal support element of—FIG. 3.
FIG. 3C is an illustration of a close up of another embodiment of a horizontal support element.

FIG. 3 is an illustration of another embodiment of the invention used for installing a fence panel on the front face of two Fence Posts (A, B). A fence panel installation system (300) is shown between two Fence Posts (A, B).

FIG. 3A is an illustration of a close up of the horizontal support element of FIG. 3. A horizontal support element (310) is elastically attached to each fence post by a flexible attachment element (328). A vertical element (334) is attached in a base (312) that is attached to a back (318). An alignment member (340) is shown resting upon each horizontal support 310 affixed to each of Fence Post A and Fence Post B and extending horizontally between Fence Post A and Fence Post B with a first part (342) slideably engaged with a second part (344) to allow for an adjustable length.

FIG. 3B is an illustration of another view of a close up of the horizontal support element of FIG. 3. Back 318 has two holes (322) and is temporarily affixed to fence post A2 with lag bolts (322).

FIG. 3C is an illustration of a close up of another embodiment of a horizontal support element for mounting front mounted fence panels. Vertical element 334 has a left portion (336) slideably engaged with slits (337) to a center portion (341) and a right portion (338) slideably engaged with slits (339).

The first method aspect is for mounting a fence panel between the faces of two fence posts to form a side-mounted fence. This method includes ten steps. The first step is providing at least a first anchored fence post of a pair and a second anchored fence post of a pair each with a front face and without a fence panel between them, at least one fence panel, and enough pairs of brackets necessary to install the fence panel between the first and second anchored fence post. The second is providing a fence post installation system that includes the elements of the article discussed above. The third step is releasably affixing a horizontal support element to the side of the first fence post at predetermined location. The fourth step is affixing the first of a pair of first fence panel brackets to the first fence post. The fifth step is releasably affixing the horizontal support element to a facing face of the second fence post wherein there is no fence panel between the first fence post and the second fence post and at predetermined location using the alignment member to determine a level location for the first horizontal support element and the second horizontal support element. The sixth step is affixing the second of a pair of fence panel brackets to the second fence post. The seventh step is repeating steps three to six until all pairs of fence panel brackets necessary to mount a fence panel are on the facing faces of the two fence posts. The eighth step is positioning the fence panel into the brackets. The ninth step is affixing the fence panel to the fence panel brackets to form a first fence post and a second fence post with a fence panel between them. The tenth step is repeating steps three to nine on the next panel until all panels are installed. In some embodiments, the alignment member is used to determine vertical distances between brackets in a vertical direction.

In some embodiments, the method also includes an additional step and changing an existing step. The additional step, an eleventh step, includes providing a fence panel installation system that further includes a fence panel lifting and alignment tool that includes three elements. The first element is a base configured to hold the bottom of a fence panel to be mounted to a set of fenced panel brackets. The second element includes a brace element with a top and extending vertically from the base to a height of at least one-fourth of the height of the fence panel. The third element includes a handle extending horizontally from the top of the brace. In addition, the tenth step further includes using the fence panel lifting and aligning tool to position the fence panel into in the brackets. This last is typically done when all of the brackets are affixed to the two fence posts sufficient to mount one side fence panel.

In some embodiments, the method also includes a twelfth step and making changes to the fifth step. The twelfth step includes providing a second horizontal support element. The fifth step further includes affixing the second horizontal support element on the facing face of the second fence post until the fence post panel is affixed to the two fence posts.

Figure 4:
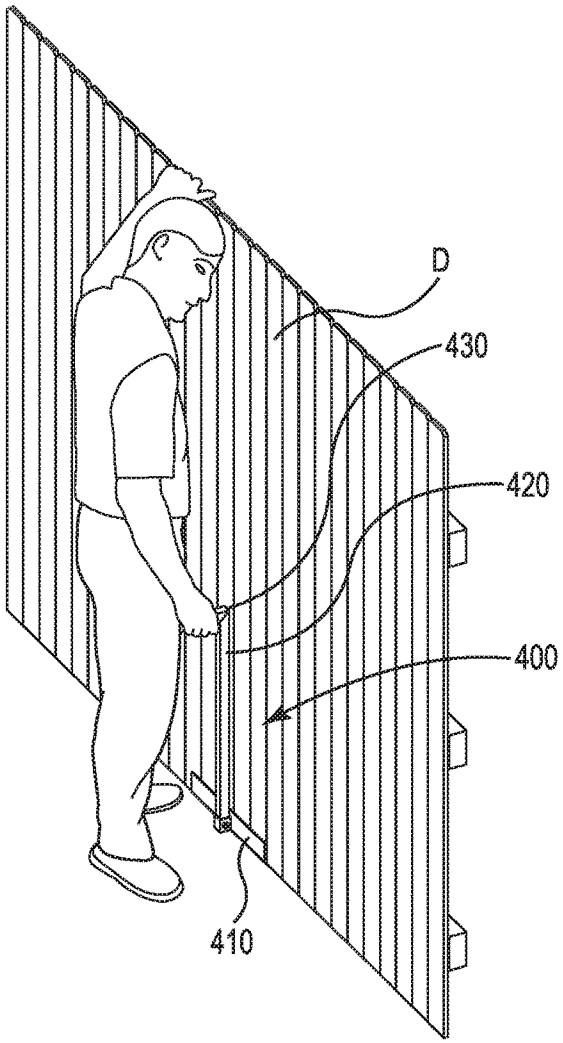
FIG. 4 is an illustration of a person carrying a fence panel with an embodiment of a lifting and aligning tool of the invention.

FIG. 4 is an illustration of a person carrying a fence panel with an embodiment of a lifting and aligning tool of the invention. A fence panel (D) is shown being lifted by a person with a panel lifting and alignment tool (400). Panel lifting and alignment tool 400 is shown with a base (410), attached to a brace (420) that is attached to a handle (420) being held by a person who is standing.

Figure 5:
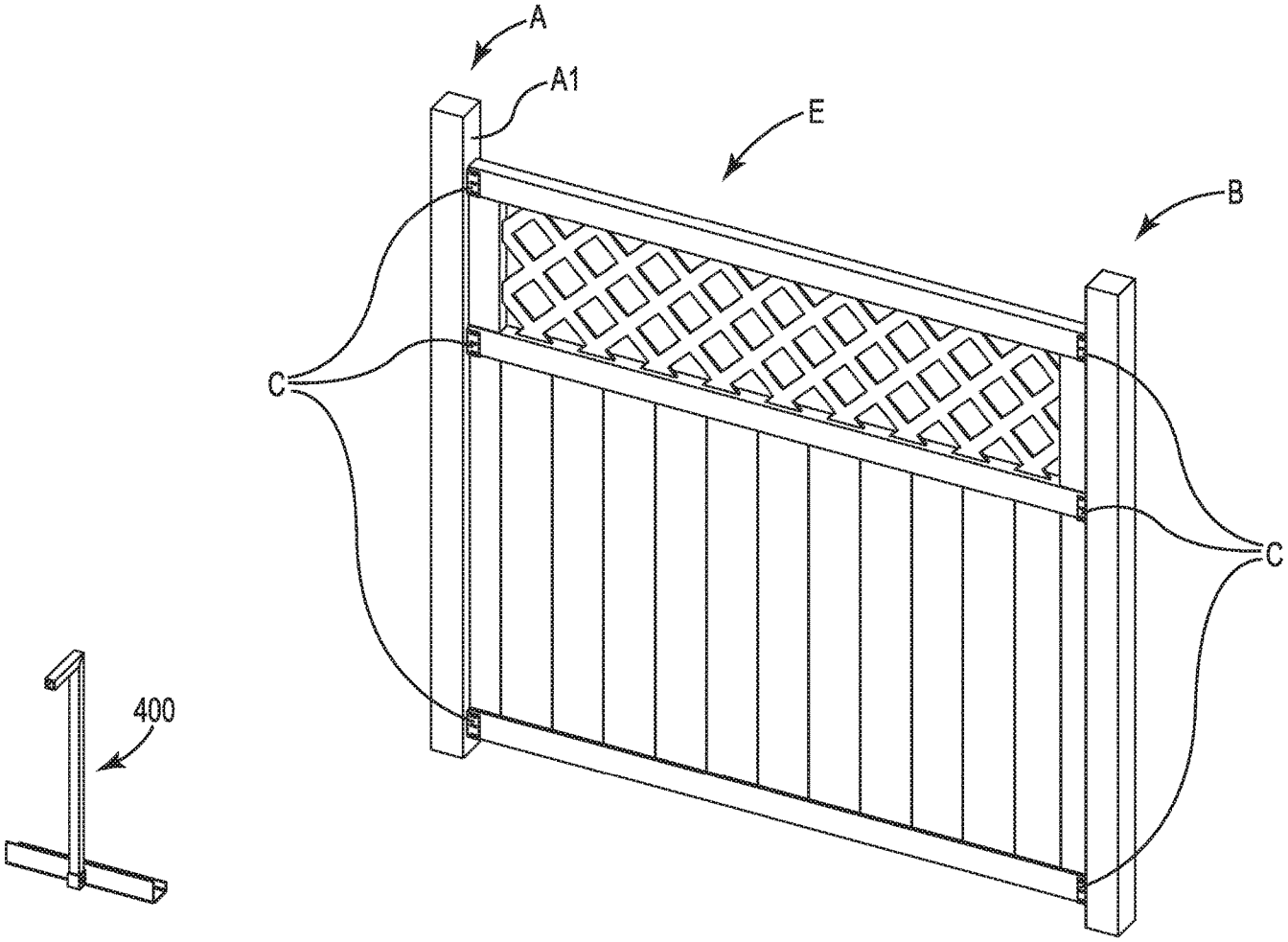
FIG. 5 is an illustration of a fence panel mounted with brackets between two fence posts and an illustration of the lifting and aligning tool of the invention.

FIG. 5 is an illustration of a fence panel mounted with brackets between two fence posts and an illustration of the lifting and aligning tool of the invention. A side mountable fence panel (E) is shown mounted with three fence panel brackets C on fence post A and three fence panel brackets C on fence post B. Panel lifting and alignment tool 400 is shown beside the mounted fence panel.

The second method aspect is for mounting a fence panel on the front faces of two fence posts to form a front-mounted fence. This method includes seven steps. The first step is providing at least a first and a second anchored fence post each with a front face and without a fence panel between them and at least one fence panel to be mounted on the front face of the first and second anchored fence panel. The second step is providing a fence post installation system that includes the elements of the article discussed above but with a first horizontal support element and a second horizontal support element. The third step is releasably affixing the first horizontal support element to front face of the first fence post and the second horizontal support element to the front face of the second fence post wherein there is no fence panel between the first fence post and the second fence post and at predetermined locations using the alignment member to determine a level location for the first horizontal support element and the second horizontal support element. The fourth step is more securely affixing the first horizontal support element to the first fence post and the second horizontal support element to the second fence post. The fifth step is positioning the fence panel onto the horizontal support element of each fence post and affixing the facing fence panel to each fence post to form a first fence post and a second fence post with a fence panel between them. The sixth steep is releasing the first horizontal support element from the first fence post and the second horizontal support element from the second fence post. The seventh step is repeating steps three through six on the next panel until all panels are installed.

In some embodiments, the method also includes an additional step and changing an existing step. The additional step, an eighth step, includes providing a fence panel installation system that further includes a fence panel lifting and alignment tool that includes three elements. The first element is a base configured to hold the bottom of a fence panel to be mounted to a set of fenced panel brackets. The second element includes a brace element with a top and extending vertically from the base to a height of at least one-fourth of the height of the fence panel. The third element includes a handle extending horizontally from the top of the brace. In addition, the fifth step further includes using the fence panel lifting and aligning tool to position the fence panel onto the more secured horizontal support elements. Then the fence panel is affixed to the front faces of the two fence posts.

Figure 6:
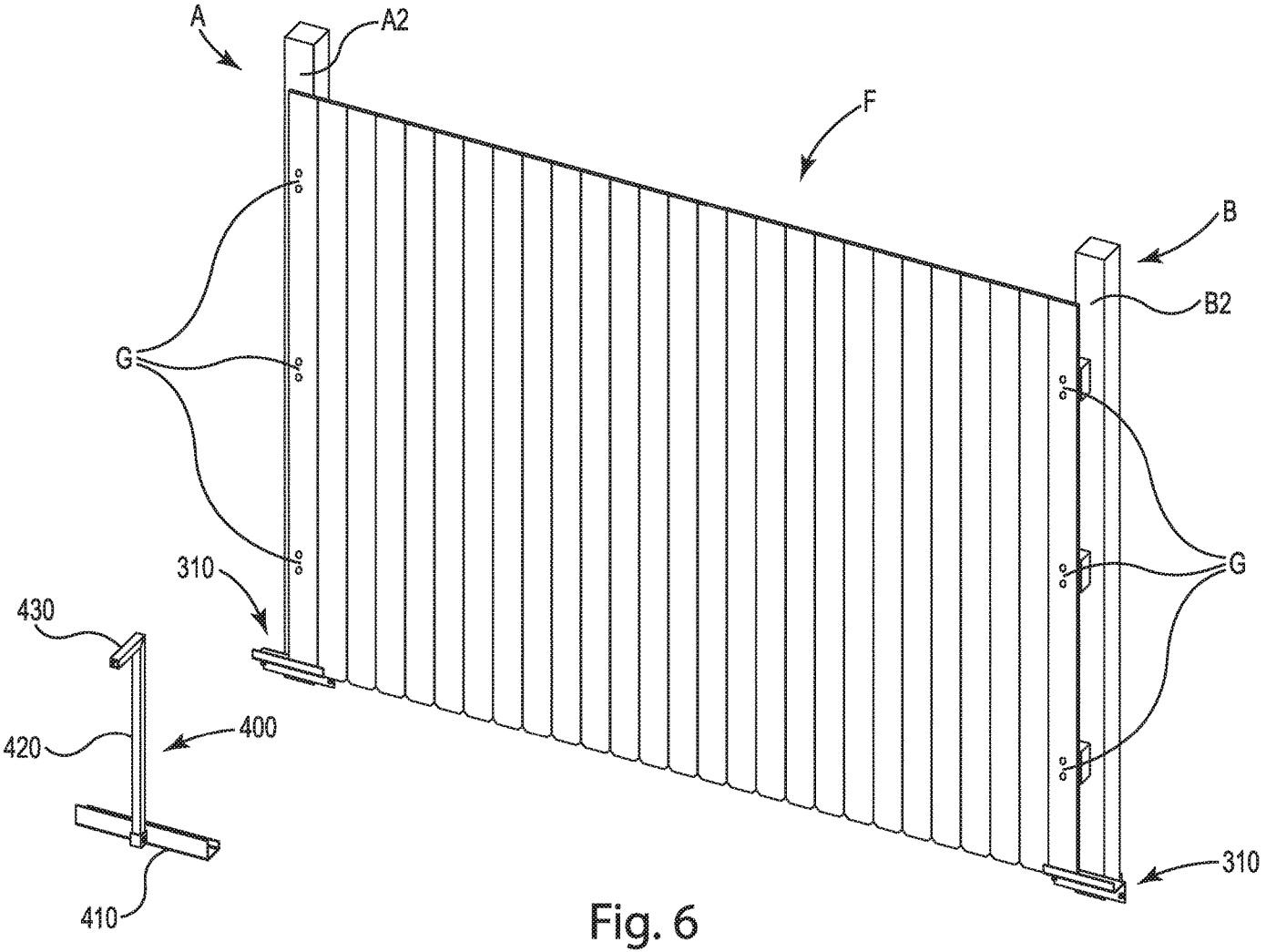
FIG. 6 is an illustration of a fence panel being mounted to the front face of two fence posts and an illustration of the lifting and aligning tool of the invention.

FIG. 6 is an illustration of a fence panel being mounted to the front face of two fence posts and an illustration of the lifting and aligning tool of the invention. A fence panel (F) is being supported by two horizontal support elements 310, one each on each of two fence posts (A. B) on their front faces (A2, B2). The fence panel is shown having just been affixed to the two fence posts with nails or screws (G). Panel lifting and alignment tool 400 is shown beside the mounted fence panel.

The various elements of the article of the invention may be made using conventional materials and manufacturing techniques. Materials include, for example, metals such as aluminum or steel, rigid plastics such as vinyl, and composites having similar durability and strength properties.

Some embodiments of my invention also include a fence panel lifting and alignment tool. This tool includes three elements, a base, a brace element, and a handle. The base is configured to hold the bottom of a fence panel to be mounted to a set of fenced panel brackets. The brace element includes a top and extending vertically from the base to a height of at least half that of a height of the fence panel. The handle extends horizontally from the top of the brace.

Other modifications and changes regarding my invention will be apparent to those skilled in the art. The invention is not considered limited to the embodiments chosen for purposes of disclosure and covers all changes and modifications that do not constitute departures from the true spirit and scope of this invention.

I claim:

1. A fence panel installation system comprising:

at least one horizontal support element comprising:

a left portion and a right portion configured to be slideably engaged to accommodate fence posts with various horizontal widths;

a base with back edge, a left edge, a right edge, a front edge, a top surface, at least a left portion and a right portion, and a length that is configured to extend beyond the horizontal width of a face of a fence post on which a panel mounting bracket is configured to be releasably affixed;

a back with a back surface configured to be partially in contact with a face of a fence post and at least a left portion and a right portion that extend at right angles down from the back edge of each portion of the base and has at least a left portion that has left end and a length that extends from proximate the left edge of the base, a right portion that has right end and a length that extends from proximate the right edge of the base and a continuous flexible attachment element attached to the left and right portion of the back and that is configured to allow the horizontal support element to be elastically releasably attach to the fence post at a predetermined location; and an alignment member with a left end and a right end and an adjustable length that has two portions that are slideably engaged, the left end is proximate to the fence post, and the right end is proximate to another fence post.

2. The fence panel installation system of claim 1 wherein the fence panel installation system comprises a second horizontal support element.

3. The fence panel installation system of claim 1 wherein the horizontal support element is configured to install a side mounted fence panel bracket and at least one portion of the horizontal support element further comprises an alignment element horizontally mounted and slideably engaged to the horizontal support element in a direction parallel to the back edge of the base and having a first surface configured to contact a face of a fence post that is at right angles to the face being attached to the side mounted fence panel bracket.

4. The fence panel installation system of claim 1 wherein the horizontal support element is configured to install a side mounted fence panel bracket and the base of the horizontal support element further comprises a vertical engaging element with a rear edge and extending up from the surface of the base and perpendicular to the front edge and the engaging element is configured with a projection off its rear edge to engage a hole in a fence panel bracket while it can be affixed to the face of the fence post.

5. The fence panel installation system of claim 1, further comprising a fence panel lifting and alignment tool, the alignment tool comprising:

a base configured to hold the bottom of a fence panel to be mounted to a set of fenced panel brackets for a side mounted fence or a fence panel for a face mounted fence panel;

a brace element with a top and extending vertically from the base to a height of at least one-fourth of a height of the fence panel; and a handle extending horizontally from the top of the brace.

6. The fence panel installation system of claim 1 wherein two portions of the horizontal support element are unified.

7. The fence panel installation system of claim 1 wherein the base further comprises a third portion between the left portion and the right portion of the base and back and slideably engaged with both the left portion and right portion of the base and the back.

8. The fence panel installation system of claim 1 wherein the horizontal support element, further comprises, a vertical element having a top, a left portion, and a right portion, and affixed to the front edge of the left and right portion of the base, extending upward at right angles to the base.

9. The fence panel installation system of claim 8 wherein the left portion and the right portion of the vertical element are slideably engaged.

10. The fence panel installation system of claim 8 wherein the left portion and the right portion of the vertical element are unified.

11. The fence panel installation system of claim 8 wherein the alignment member has a projection at one end that is configured to engage the top of the vertical element.

12. The fence panel installation system of claim 8 wherein the back has at least two holes configured to permit the horizontal support element to be releasably affixed to the face of the fence post to permit a facing fence panel to rest upon the horizontal support element until the fence panel is affixed to the face of the fence post.

13. A method of installing a fence panel in a side-mounted fence comprising:

providing at least a first anchored fence post of a pair and a second anchored fence post of a pair each with a front face and without a fence panel between them, at least one fence panel, and enough pairs of brackets necessary to install the fence panel between the first and second anchored fence post;

providing a fence post installation system, the installation system including:

at least one horizontal support element comprising:

a left portion and a right portion configured to be slideably engaged to accommodate fence posts with various horizontal widths;

a base with back edge, a left edge, a right edge, a front edge, a top surface, at least a left portion and a right portion, and a length that is configured to extend beyond the horizontal width of a face of a fence post on which a panel mounting bracket is configured to be releasably affixed;

a back with a back surface configured to be partially in contact with a face of a fence post and at least a left portion and a right portion that extend at right angles down from the back edge of each portion of the base and has at least a left portion that has left end and a length that extends from proximate the left edge of the base, a right portion that has right end and a length that extends from proximate the right edge of the base; and a continuous flexible attachment element attached to the left and right portion of the back and that is configured to allow the horizontal support element to be elastically releasably attach to the fence post at a predetermined location; and an alignment member with a left end and a right end and an adjustable length that has two portions that are slideably engaged, the left end is proximate to the fence post, and the right end is proximate to another fence post;

releasably affixing a horizontal support element to a facing face of the first of the pair of fence post without a fence panel between them at a predetermined location;

affixing the first of a pair of first fence panel brackets to the first fence post;

releasably affixing the horizontal support element to a facing face of the second fence post wherein there is no fence panel between the first fence post and the second fence post and at predetermined location using the alignment member to determine a level location for the first horizontal support element and the second horizontal support element; and affixing the second of a pair of fence panel brackets to the second fence post positioning the fence panel into the brackets; and affixing the fence panel to the fence panel brackets to form a first fence post and a second fence post with a fence panel between them.

14. The method of claim 13, further comprising providing a fence panel installation system that has a fence panel lifting and alignment tool, wherein the fence panel lifting and alignment tool includes:

a base configured to hold the bottom of a fence panel to be mounted to a set of fenced panel brackets;

a brace element with a top and extending vertically from the base to a height of at least one-fourth of a height of the fence panel; and a handle extending horizontally from the top of the brace.

15. The method of claim 13, further comprising providing a second horizontal support element and affixing the second horizontal support element on the facing face of the second fence post until the fence post panel is affixed to the two fence posts.

16. A method of installing a fence panel in a face-mounted fence comprising:

providing at least a first and a second anchored fence post each with a front face and without a fence panel between them and at least one fence panel to be mounted on the front face of the first and second anchored fence panel;

providing a fence post installation system, wherein the fence post installation system includes a first and a second horizontal support element with each support element having a left portion and a right portion configured to be slideably engaged to accommodate fence posts with various horizontal widths; a base with back edge, a left edge, a right edge, a front edge, a top surface, at least a left portion and a right portion, and a length that is configured to extend beyond the horizontal width of a face of a fence post on which a panel mounting bracket is configured to be releasably affixed;

a back with a back surface configured to be partially in contact with a face of a fence post and at least a left portion and a right portion that extend at right angles down from the back edge of each portion of the base and has at least a left portion that has left end and a length that extends from proximate the left edge of the base, a right portion that has right end and a length that extends from proximate the right edge of the base; and a continuous flexible attachment element attached to the left and right portion of the back and that is configured to allow the horizontal support element to be elastically releasably attach to the fence post at a predetermined location; and an alignment member with a left end and a right end and an adjustable length that has two portions that are slideably engaged, the left end is proximate to the fence post, and the right end is proximate to another fence post; releasably affixing the first horizontal support element to front face of the first fence post and the second horizontal support element to the front face of the second fence post wherein there is no fence panel between the first fence post and the second fence post and at predetermined locations using the alignment member to determine a level location for the first horizontal support element and the second horizontal support element;

securing the first horizontal support element to the first fence post and the second horizontal support element to the second fence post;

positioning the fence panel onto the horizontal support element of each fence post and affixing the facing fence panel to each fence post to form a first fence post and a second fence post with a fence panel between them; and releasing the first horizontal support element from the first fence post and the second horizontal support element from the second fence post.

17. The method of claim 16 further comprising providing a fence panel installation system that further comprises a fence panel lifting and alignment tool, wherein the tool includes (a). a base configured to hold the bottom of a fence panel to be mounted to a pair of fence posts, a brace element with a top and extending vertically from the base to a height of at least one-fourth of a height of the fence panel, and a handle extending horizontally from the top of the brace; and using the fence panel lifting and aligning tool to position the fence panel onto the more secured horizontal support elements.

18. A fence panel installation system comprising:

at least one horizontal support element comprising:

a left portion and a right portion configured to be slideably engaged to accommodate fence posts with various horizontal widths;

a base with back edge, a left edge, a right edge, a front edge, a top surface, at least a left portion and a right portion, and a length that is configured to extend beyond the horizontal width of a face of a fence post on which a panel mounting bracket is configured to be releasably affixed;

a back with a back surface configured to be partially in contact with a face of a fence post and at least a left portion and a right portion that extend at right angles down from the back edge of each portion of the base and has at least a left portion that has left end and a length that extends from proximate the left edge of the base, a right portion that has right end and a length that extends from proximate the right edge of the base; and a continuous flexible attachment element attached to the left and right portion of the back and that is configured to allow the horizontal support element to be elastically releasably attach to the fence post at a predetermined location; and an alignment member with a left end and a right end and an adjustable length that has two portions that are slideably engaged, the left end is proximate to the fence post, and the right end is proximate to another fence post, wherein the horizontal support element is configured to install a side mounted fence panel bracket and the base of the horizontal support element further comprises a vertical engaging element with a rear edge and extending up from the surface of the base and perpendicular to the front edge and the engaging element is configured with a projection off its rear edge to engage a hole in a fence panel bracket while it can be affixed to the face of the fence post.

19. A fence panel installation system comprising:

at least one horizontal support element comprising:

a left portion and a right portion configured to be slideably engaged to accommodate fence posts with various horizontal widths;

a base with back edge, a left edge, a right edge, a front edge, a top surface, at least a left portion and a right portion, and a length that is configured to extend beyond the horizontal width of a face of a fence post on which a panel mounting bracket is configured to be releasably affixed;

a back with a back surface configured to be partially in contact with a face of a fence post and at least a left portion and a right portion that extend at right angles down from the back edge of each portion of the base and has at least a left portion that has left end and a length that extends from proximate the left edge of the base, a right portion that has right end and a length that extends from proximate the right edge of the base; and a continuous flexible attachment element attached to the left and right portion of the back and that is configured to allow the horizontal support element to be elastically releasably attach to the fence post at a predetermined location; and an alignment member with a left end and a right end and an adjustable length that has two portions that are slideably engaged, the left end is proximate to the fence post, and the right end is proximate to another fence post, wherein the horizontal support element, further comprises, a vertical element having a top, a left portion, and a right portion, and affixed to the front edge of the left and right portion of the base, extending upward at right angles to the base, and wherein the alignment member has a projection at one end that is configured to engage the top of the vertical element.

20. A fence panel installation system comprising:

at least one horizontal support element comprising:

a left portion and a right portion configured to be slideably engaged to accommodate fence posts with various horizontal widths;

a base with back edge, a left edge, a right edge, a front edge, a top surface, at least a left portion and a right portion, and a length that is configured to extend beyond the horizontal width of a face of a fence post on which a panel mounting bracket is configured to be releasably affixed;

a back with a back surface configured to be partially in contact with a face of a fence post and at least a left portion and a right portion that extend at right angles down from the back edge of each portion of the base and has at least a left portion that has left end and a length that extends from proximate the left edge of the base, a right portion that has right end and a length that extends from proximate the right edge of the base; and a continuous flexible attachment element attached to the left and right portion of the back and that is configured to allow the horizontal support element to be elastically releasably attach to the fence post at a predetermined location; and an alignment member with a left end and a right end and an adjustable length that has two portions that are slideably engaged, the left end is proximate to the fence post, and the right end is proximate to another fence post, wherein the horizontal support element, further comprises, a vertical element having a top, a left portion, and a right portion, and affixed to the front edge of the left and right portion of the base, extending upward at right angles to the base, and wherein the back has at least two holes configured to permit the horizontal support element to be releaseably affixed to the face of the fence post to permit a facing fence panel top rest upon the horizontal support element until the fence panel is affixed to the face of the fence post.

* * * * *